US005851160A

United States Patent [19]

Rugge et al.

[11] Patent Number: 5,851,160

[45] Date of Patent: Dec. 22, 1998

[54] METALWOOD GOLF CLUB HEAD

[75] Inventors: Richard L. Rugge, Encinitas; Jean Hue, Carlsbad; Richard S. Wahlin, San Diego; David L. Rose, Cardiff, all of Calif.

[73] Assignee: Taylor Made Golf Company, Inc., Carlsbad, Calif.

[21] Appl. No.: 840,077

[22] Filed: Apr. 9, 1997

[51] Int. Cl.[6] ..... A63B 53/04

[52] U.S. Cl. ..... 473/349; 473/346

[58] Field of Search ..... 473/349, 334, 473/335, 336, 338, 344, 345, 346

[56] References Cited

U.S. PATENT DOCUMENTS

| | | | |
|---|---|---|---|
| 3,941,390 | 3/1976 | Hussey | 473/349 |
| 4,085,934 | 4/1978 | Churchward | 473/338 |
| 4,214,754 | 7/1980 | Zebelean | 473/346 |
| 4,432,549 | 2/1984 | Zebelean | 473/346 |
| 5,251,901 | 10/1993 | Solheim et al. | 473/338 |
| 5,310,186 | 5/1994 | Karsten | 473/345 |
| 5,447,309 | 9/1995 | Vincent | 473/335 |
| 5,669,827 | 9/1997 | Nagamoto | 473/345 |
| 5,755,624 | 5/1998 | Helmstetter . | |

FOREIGN PATENT DOCUMENTS

| | | |
|---|---|---|
| 5334330 | 12/1993 | Japan . |
| 2100993 | 1/1983 | United Kingdom . |

*Primary Examiner*—Steven Wong

*Attorney, Agent, or Firm*—Knobbe, Martens, Olson & Bear, LLP

[57] ABSTRACT

An enlarged metalwood golf club head, including a hollow body and a weight pad. The hollow body includes an inner cavity surrounded by sole portion, an impact face, a heel portion, a toe portion, a rear face portion joining the heel portion to the toe portion and a crown portion joining the impact face, the toe portion, the heel portion and the rear face portion. The heel portion includes an opening for the introduction and connection of a shaft. The opening defines an axis. A weight pad is located within the cavity of the body along the sole portion so that the center of gravity of the golf club head is located beneath the center of the impact face and closer to the heel portion than the toe portion. Desirably, the metal head has a size and a shape such that the head has a high moment of inertia about the vertical axis y passing through the center of gravity so that the head has increased resistance to horizontal rotation upon off-centered strokes.

15 Claims, 5 Drawing Sheets

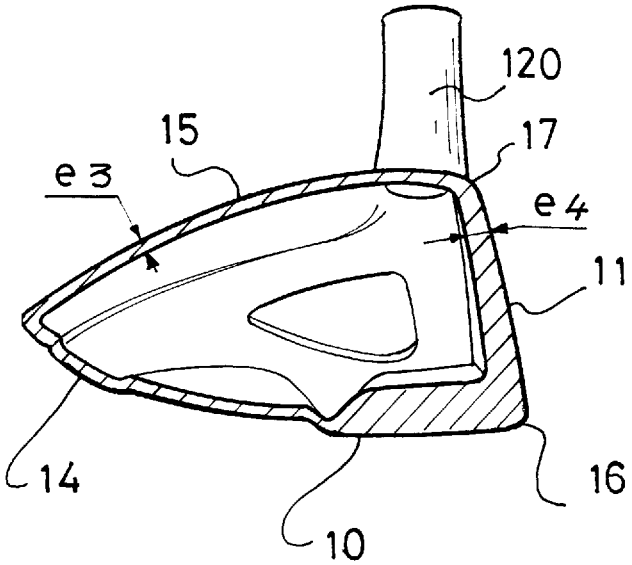
Fig: 5
Fig: 6
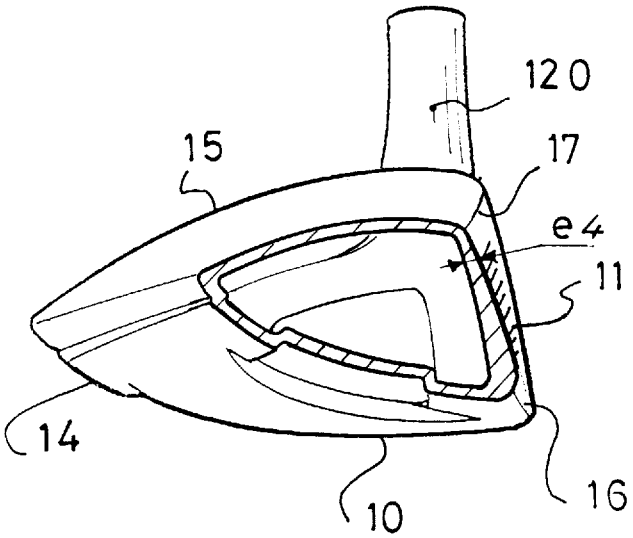
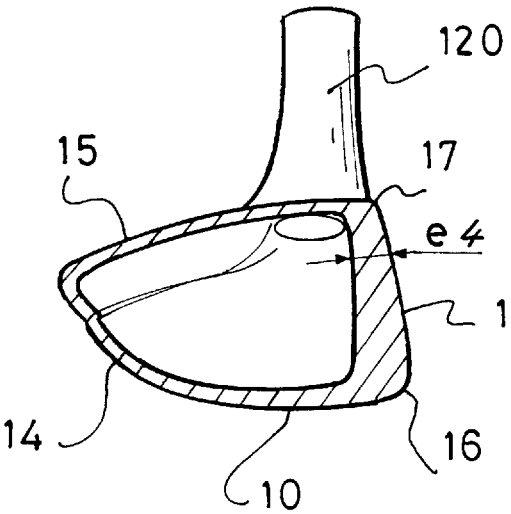
Fig: 7

METALWOOD GOLF CLUB HEAD

BACKGROUND OF THE INVENTION AND SUMMARY OF THE INVENTION

1. Field of the Invention

The invention relates to a metalwood style golf club head and, more particularly, to an oversized metalwood head.

2. Description of Background and Related Art

It has become common for the majority of players to utilize golf clubs having metal, typically steel, heads for longer shots. These conventional heads generally have a volume which does not exceed 190 cc for a driver. The trend, however, is to design heads having significantly increased volume, but with a weight and a resistance within certain parameters. The weight and resistance is limited through the use of materials, such as titanium or titanium-based alloys. The major effect of the increased head volume is to enlarge the impact face of the club and, in particular, the "sweet spot" area.

The Applicant has determined, however, that the increase of head volume is typically accompanied proportionally by displacement of the center of gravity of the club head. In particular, when the volume of the club head increases, the center of gravity tends to shift upward and away from the shaft axis.

When the center of gravity is located too high, and particularly when the center of gravity is located above the center of the impact face, the Applicant has determined that more back spin is created. Specifically, the back spin rate is typically on the order of 3,500 to 4,000 revolutions per minute. This increased back spin results in an undesirable altering of the ball trajectory. Specifically, the ball tends to go up more abruptly and to travel a shorter distance, known as a "ballooning trajectory," which is highly undesirable. Unfortunately, most golf clubs having enlarged heads produce a ballooning trajectory as a result of the improper vertical position of the center of gravity (i.e., the positioning of the center of gravity too high with respect to the face center).

A second important parameter with respect to the design of the club head is the position of the center of gravity with respect to the shaft axis. When the volume of the club head increases, the center of gravity tends to move away from the shaft axis. If the club is not modified to overcome this result, the moment of inertia with respect to the shaft axis will increase significantly, making the head harder to pivot during the swing motion. Consequently, the impact face will not be returned to a sufficiently perpendicular position with respect to the swing plane upon impact. This results in a slice effect, causing the ball to deviate to the right for a right-handed club, or to the left for a left-handed club.

Accordingly, a need exists for an improved golf club head having a center of gravity which is located in a manner which avoids a ballooning trajectory of the golf ball and facilitates the return of the golf club head to a perpendicular position upon impact. Advantageously, this improved golf club head will comprise an oversized golf club head, to achieve the benefits of the enlarged impact face of the club, and a larger sweet spot. Preferably, the head will have a volume equal or greater than 250 cc.

One prior effort to develop an improved golf club head of the metalwood type is disclosed in U.S. Pat. No. 5,310,186 to Karsten. Karsten discloses a metalwood head utilizing a weight pad disposed along the side wall between the sole and the crown portion of the head. Specifically, the weight pad is located in the heel portion of the side wall. Karsten teaches that the weight pad provides the club head with increased resistance to horizontal rotation or twisting around a vertical axis extending through the center of gravity when the impact face of the head impacts a golf ball at points which are laterally off-centered from the sweet spot. The positioning of a mass in this area, however, is undesirable for a metalwood head because it prevents a sufficiently low center of gravity from being achieved with respect to the impact face and because it causes the center of gravity to move back too much with respect to the vertical plane A, as shown in the patent. These defects are, of course, magnified by the fact that the entire head is enlarged with respect to a conventional head. U.S. Pat. No. 5,310,186 assumes that the sweet spot is aligned with the center of the impact face and further teaches the alignment of the sweet spot with the center of gravity, so that when a golf ball is impacted at the sweet spot center, no rotation of the club head will occur. As discussed below, this is believed to be undesirable.

Japanese patent application (A) 7-185049 to Kobayashi Kenji discloses a golf club head having an outer shell comprised of titanium alloy having a volume of 240 cc or more. The head is plugged with a ten-gram or more weight consisting of titanium alloy embedded in the lower part of the rear side of the shell. Undesirably, however, the weight is not properly positioned, causing the head to have the same drawbacks as the head disclosed in the patent of Karsten.

Applicant has determined that it is important to maximize the moment of inertia about the vertical axis passing through the center of gravity of the golf club head. Hereinafter in this application the moment of inertia about the vertical axis passing through the center of gravity shall be identified as "Iy." Applicant has determined that low values of inertia cause a lateral deviation of the ball with respect to the targeted trajectory and also causes significant decrease in distance when the impact occurs in a zone that is laterally offset in relation to the center of the impact face. This decrease in distance is primarily due to the fact that the energy transferred to the ball is lower when the impact occurs in the off-centered areas, rather than the center of the impact face.

U.S. Pat. No. 4,432,549 to Zebelean discloses an all metal driver whose mass is distributed in a manner to reduce its torque and/or deflection. The mass is distributed so that it increases from the top side toward the sole side and from the heel toward the toe. This mass distribution tends to put the center of gravity in a relatively sole/heel position and is not suitable for an oversized head since it would significantly increase the moment of inertia around the shaft axis. As a result, the head would become harder to rotate during the swing motion and the resultant stress on the shaft could potentially lead to shaft breakage.

Accordingly, there is needed an oversized head which achieves the proper combination of positioning of the center of gravity and the value of inertia Iy so as to achieve a satisfyingly straight trajectory without the undesirable ballooning effect, (i.e., a "boring" trajectory), a proper positioning of the face at the moment of impact and a high forgiveness in the case of an off-centered stroke.

One aspect of Applicant's invention is an improved metalwood golf club head. The head desirably has an enlarged volume, having a center of gravity located sufficiently low to confer a consistent and long "boring" trajectory and a center of gravity close to the shaft axis to achieve a proper perpendicular normal position of the impact face in relation to the swing plane.

One aspect of the invention is an enlarged metalwood golf club head, including a hollow body and a weight pad. The hollow body includes an inner cavity surrounded by sole portion, an impact face, a heel portion, a toe portion, a rear face portion joining the heel portion to the toe portion and a crown portion joining the impact face, the toe portion, the heel portion and the rear face portion. The heel portion includes an opening for the introduction and connection of a shaft. The opening defines an axis. A weight pad is located within the cavity of the body along the sole portion so that the center of gravity of the golf club head is located beneath the center of the impact face and closer to the heel portion than the toe portion.

Advantageously, the weight pad is located in a zone of the sole portion whose average length extends from the vicinity of the heel portion to a line located at or in proximity to the vertical median plane extending through the center of the impact face. Further, the weight pad desirably has an average width which extends from proximate the impact face along only a part of the total width of the sole portion.

Another aspect of the invention is a metal head having a size and a shape such that the head has a high moment of inertia about the vertical axis y passing through the center of gravity (i.e., a high Iy) so that the head has increased resistance to horizontal rotation upon off-centered strokes.

Desirably, the head includes a moment of inertia Iy about the vertical axis passing through the center of gravity which is greater than or equal to three hundred kg.mm$^2$. Preferably, the head has a moment of inertia about the vertical axis passing through the center of gravity which is greater than or equal to 320 kg.mm$^2$.

Advantageously, the metal head of applicant's invention is particularly adapted for use in high volume metalwood heads. It is believed that the importance of the interrelationship between the above described parameters was not recognized in the prior art. The teaching of the present invention, however, permits the manufacture of oversize golf club heads providing both greater performance and more forgiveness.

Yet another aspect of the invention is a golf club head in which the center of gravity of the head is located a certain distance behind a plane including the shaft axis and parallel to a horizontal line tangent to the impact face and extending through the center of the impact face, thereby providing a certain dynamic loft. This loft desirably lifts the ball up and promotes a slight natural deviation of the ball to the left side, as is preferred by a majority of players (for a right-handed club, and vice-versa; to the left for a left-handed club). Desirably, the distance between the center of gravity and the plane is between 11 and 17 mm. Preferably, this distance is between 13 and 17 mm. Applicant has determined that when the distance is greater than 17 mm, the center of gravity is too far behind the vertical parallel plane tangent to the face and confers too substantial a tendency to deviate to the right. As such, the positioning ceases to have a corrective effect, but constitutes a major defect in the club design.

BRIEF DESCRIPTION OF THE DRAWINGS

Other characteristics and advantages of the invention will be better understood by means of the description which follows, with reference to the accompanying drawings, illustrating a preferred embodiment of the invention, and in which:

FIG. 5 is a cross-sectional view along B—B of FIG. 4;

FIG. 6 is a cross-sectional view along C—C in proximity to the toe of the head;

FIG. 7 is a cross-sectional view along D—D in proximity to the heel of the head;

DETAILED DESCRIPTION OF THE PREFERRED EMBODIMENT

Figure 1:
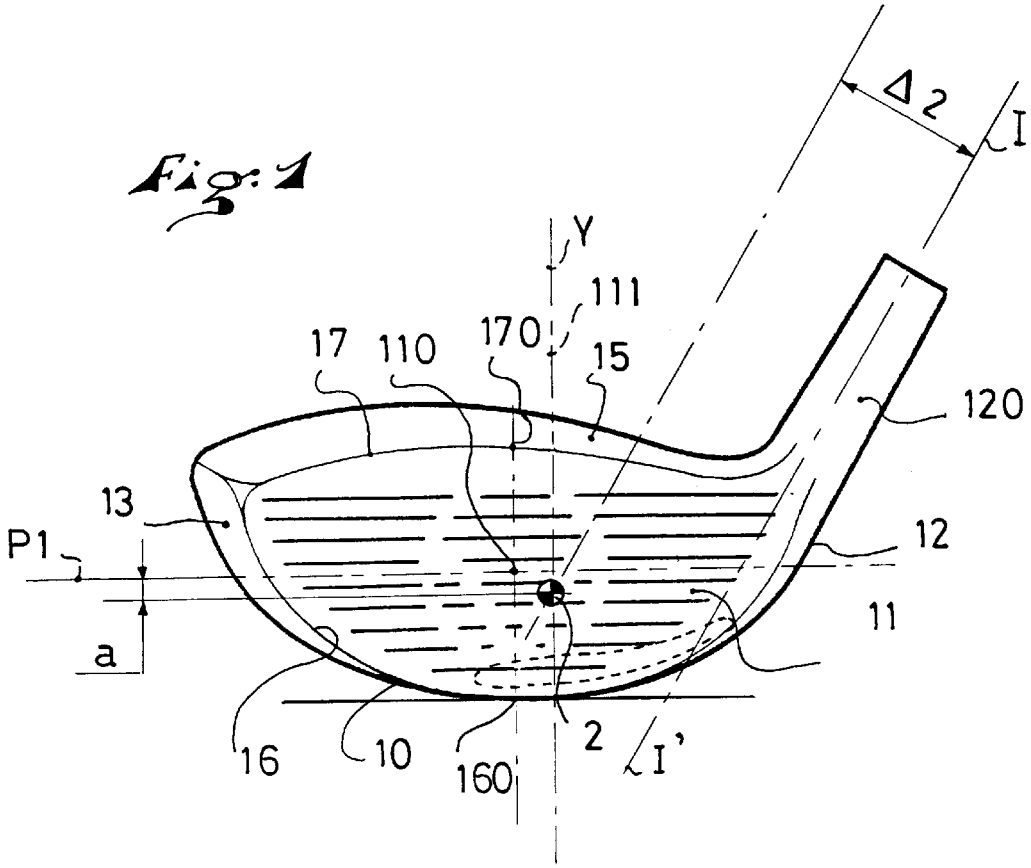
FIG. 1 is a front view of a preferred embodiment of a metalwood head.

Referring to the drawings, the preferred embodiment of the metalwood head, according to the invention, will now be described. The head includes an enlarged volume, hollow body, including an inner cavity 4 defined by sole surface 10, an impact face 11, a rear face portion 14 which joins a heel portion 12 to a toe portion 13, and a crown portion 15 linking the toe portion 13, the heel portion 12 and the rear face portion 13. The heel portion 12 includes a hosel 120 which projects upwardly and which comprises a tubular opening 121 having an axis I-I', into which a shaft (not shown) is insertable. As shown in FIG. 1, the impact face intersects the sole portion 10 along a leading edge 16 which forms a substantially curved line, having a low point or nadir 160 and which has raised lateral portions at the heel and the toe, respectively. In cross-sectional view, the leading edge desirably comprises a slightly rounded edge.

Figure 2:
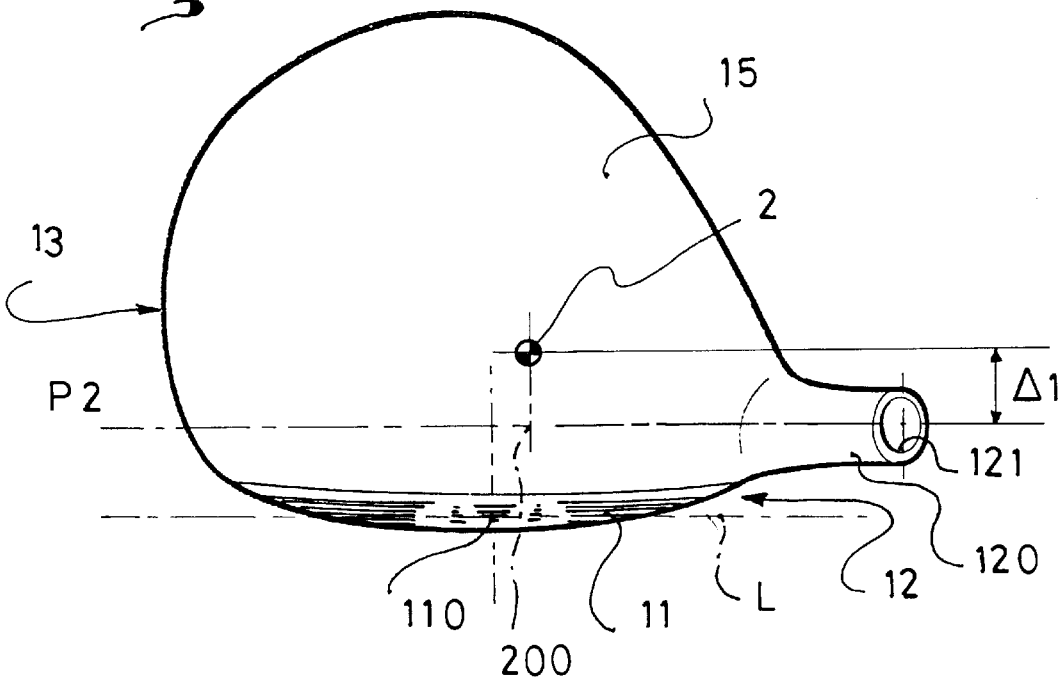
FIG. 2 is a top view of the head of FIG. 1.

Referring to FIGS. 1 and 2, the head has a center of gravity. The position of the center of gravity is shown in the Figures with respect to the impact face center and the shaft axis. Specifically, while the center of gravity is located inside the cavity of the body, the center of gravity 2 shown in FIG. 1 is a projection of the center of gravity on the surface of the impact face 11 and the position of the center of gravity 2 in FIG. 2 is a projection of the center of gravity on the crown portion 15 of the head.

Referring to FIG. 1, the center of gravity 2 is located beneath a horizontal plane P1 passing through the center of the impact face. By convention, the center of the impact face 110 is regarded as being the median point of the section of the line 111 which follows the impact face which starts from the nadir 160 and ends at the junction point 170 of the upper end of the face.

Advantageously, the distance (a) between the plane P1 and the center of gravity 2 should be between 0.5 and 10 mm, so as to maintain the back spin rate of the golf ball within acceptable limits. Acceptable back spin rate limits are considered to be between 2700 and 3200 revolutions per minute. Preferably, the distance (a) is between 0.5 and 4 mm. When the center of gravity is positioned too high, for example, at the same level as the center of the face, as is taught by U.S. Pat. No. 5,310,186 or above the center of the impact face, too much back spin is applied to the ball.

Figure 10:
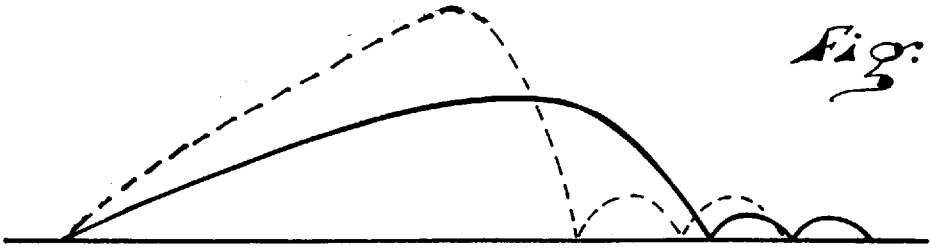
FIG. 10 is a schematic representation of the ball trajectory, starting both from the same start point for a club comprising a conventional large head of the metalwood type illustrated with a dotted line, and a ball trajectory for a club comprising an oversized head of the preferred embodiment of the invention in a solid line.

Specifically, the ball will have a back spin of approximately 3500 to 4000 revolutions per minute. As discussed above, this tends to give the golf ball a ballooning trajectory, as shown by the dotted line in FIG. 10. In contrast, when the center of gravity is within the desired limits, the resulting trajectory has a lower angle resulting in longer flight and, accordingly, is more desirable for hitting longer shots. This desired trajectory is shown in solid lines in FIG. 10.

Another important parameter of the head design is the component Δ2, which comprises the distance between the center of gravity and the shaft axis I-I'. This distance determines the positioning of the impact face at the moment of impact on golf ball. Specifically, in the preferred embodiment, the center of gravity is closer to the shaft axis I-I', with respect to a conventional oversized head, thereby reducing the moment of inertia about the shaft axis I-I'. This makes rotation of the head easier during the swing motion and enhances the proper perpendicular positioning of the head in relation to the targeted trajectory. The component Δ2, herein called the "distance between the center of gravity and the shaft axis" (consider renaming) is in actuality the distance between the shaft axis I-I' to a point 200 obtained by the orthogonal projection of the center of gravity on plane P2. Plane P2 is the plane including the shaft axis I-I' and which is parallel to the horizontal line L tangent to the face and passing through the center 110 of the impact face. Advantageously, the distance between the center of gravity and the shaft axis Δ2 is equal to or greater than 27 mm and less than or equal to 33 mm from the shaft axis I-I' (i.e., 27 mm≧Δ2≧33 mm). Preferably, the center of gravity is located at a distance Δ2 equal to 30–33 mm.

The positioning of the center of gravity between the front and rear of a head also plays a significant role on the trajectory of the golf ball. In particular, this front to rear positioning is critical for the lateral trajectory of the golf ball to control the gear effect. Specifically, the gear effect is the side spin applied to the ball by the club face. While a certain amount of side spin is desirable to pull the ball back to the targeted trajectory, excessive side spin is undesirable. The center of gravity is desirably positioned rearwardly a certain distance Δ1 with respect to the plane P2 as shown in FIG. 2. This distance Δ1 which separates the plane P2 from the center of gravity 2 is desirably between 13 and 17 mm. With the positioning of the center of gravity within this range, the club head exerts a significant gear effect which results in pulling the ball back to the targeted trajectory line when the face impacts the ball at points spaced laterally off center from the sweet spot. Beyond the distance of 17 mm, however, this gear affect is too pronounced, and prevents the trajectory of the ball from being properly controlled.

As discussed above, advantageously the preferred embodiment of the invention is an oversized metalwood head having a volume greater than or equal to 250 cubic centimeters, and preferably greater than or equal to 265 cubic centimeters, so as to provide an enlarged sweet spot area and a high level of inertia, and particularly a high level of inertia about the vertical axis y passing through the center of gravity. It should be noted that the size of the metalwood head is measured by the volume the head (including the hosel) displaces when placed in water or other liquid. Heads are generally classified as standard, mid-sized and oversized. The present invention is directed to an oversized or super-size head with a volume of 250 cc or greater. In order to achieve these characteristics, the preferred material is the titanium or titanium-based alloy whose density is close to 4.5 grams per centimeter cubed (g/cm$^3$). The use of a Ti-6A1-4V type alloy whose yield strength is on the order of 120,000 psi, or of a Ti-3A1-2.5V whose yield strength is on the order of 90,000 psi is desirable. Other materials, however, having similar mechanical characteristics can be used, as well. For example, composite materials with aluminum matrix or aluminum based alloy can be used. Such aluminum matrix material has a density of 2.6 g/cm$^3$ and lower and, therefore, allows it to redistribute a greater amount of weight in the proper location.

Figure 3:
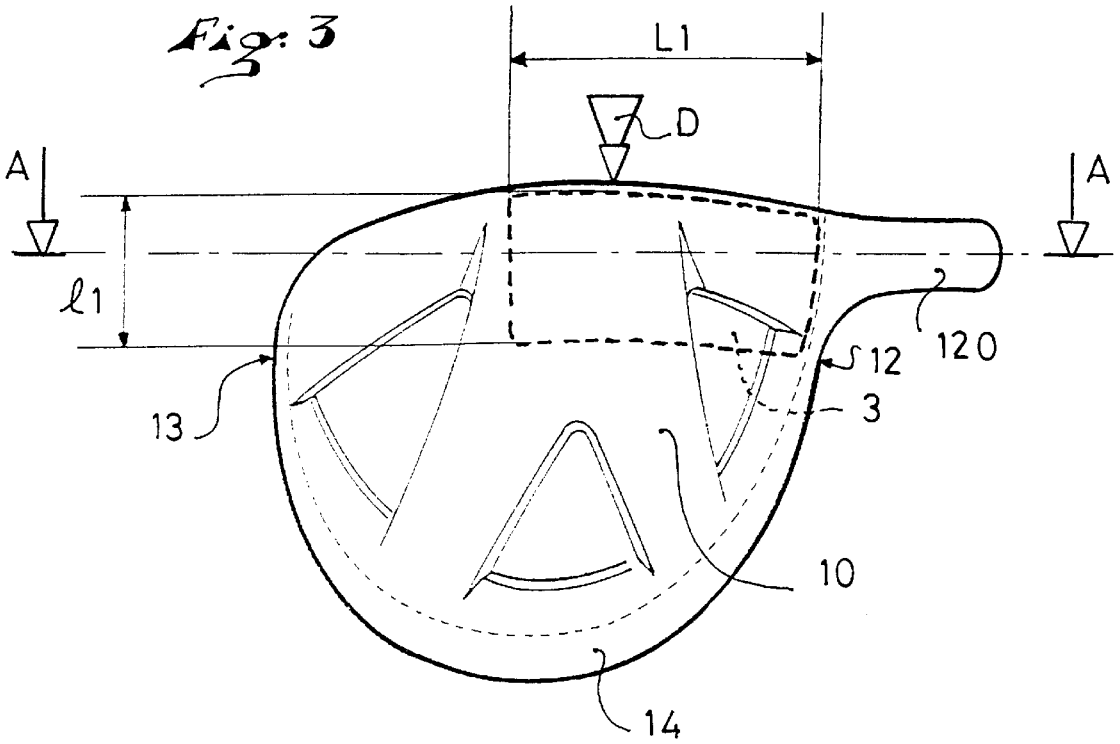
FIG. 3 is a bottom view of the head of FIG. 1.

It has been determined that in order to achieve a proper positioning of the center of gravity as previously defined for an oversized metalwood head, a weight pad 3 is desirably positioned within the cavity along the sole portion 10 and close to the heel portion 12. Preferably the weight pad 3 is located in the zone of the sole portion 10 and has an average length L1 extending from the heel portion to a line located at the limit or in proximity to the median vertical plane passing through the center of the impact face. Similarly, the weight pad 3 desirably has an average width 11 extending from a line close to or adjacent to the impact face only along a part of the total width of the sole portion. FIG. 3 shows in a dotted bold line the limits of the weight pad 3 and in a dotted regular line the contour of the sole portion 10.

The weight pad or piece 3 preferably has an average length L1 between 1.1 and 2.75 inches and an average length L1 between 0.2 and 2 inches. The average thickness e1 of the assembly formed by the sole portion and weight pad 3 is preferably between 0.07 and 0.4 inches. Accordingly, the average thickness of the zone covered by the weight pad has an average thickness e1 greater than the average thickness e of the sole portion outside of the zone covered by the weight pad. Preferably, the thickness of the sole portion outside the covering zone of the weight pad e is equal to or greater than 0.045 inches and less than or equal to 0.055 inches (i.e. 0.055 inches≦e≦0.045 inches), thereby providing the necessary mechanical resistance without making the head heavier. Preferably, the crown portion has a thickness e3 equal to or greater than 0.045 inches and less than or equal to 0.055 inches (i.e., 0.055 inches≦e3≦0.045 inches).

Desirably, the weight pad forms a thickened region or portion with respect to the thickness e which represents an additional mass between 5 and 15 grams in the case of a pure titanium or titanium-based alloy head. If the body of the head is made of a very light and strong composite material such as an aluminum matrix material and a ceramic of a density less than or equal to approximately 2.5 grams per centimeter cubed, the additional mass can represent 10 grams to approximately 50 grams. In order to limit the volume of the extra weight added within the cavity, a high density material is preferably chosen for the weight pad. Tungsten or a tungsten-based material is particularly desirable in such heads.

Figure 4:
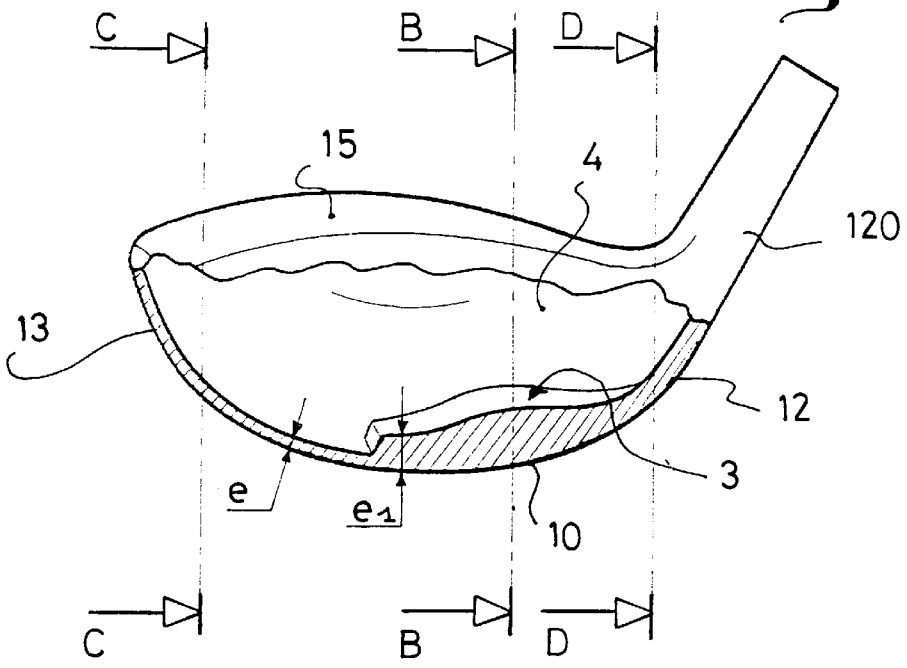
FIG. 4 is a partial view taken along A—A of FIG. 3.

FIG. 3, FIG. 4 and FIG. 5 illustrate a preferred embodiment of the invention, wherein the sole portion 10 and the weight pad 3 form a monoblock metallic and homogenous assembly produced by a casting operation. Advantageously, the lost wax technique can be used in connection with a titanium based material. As shown in FIG. 4, the weight pad and sole portion preferably form a locally enlarged area whose thickness e1 decreases progressively from a maximum thickness at a median point downward with increased distance from the median point. This form of mass distribution permits the metal supply gate of the sole plate to be positioned at the thickest region to facilitate the flow of metal to the entire bulge zone of the sole wall during the casting operation. The injection gate is designated by arrow D in FIG. 3.

To facilitate the positioning of the center of gravity below the center point of the impact face, the thickness e4 of the impact face desirably decreases as the distance from the sole portion 10 increases. Specifically, the thickness e4 of the impact face 11 desirably generally decreases from the junction line 16 between the impact face and the sole portion 10 and to the junction line 17 between the impact face and the crown portion. Preferably the decrease is progressive so as to confer a deformation behavior which is homogeneous during impact. On the other hand, the face could also include reinforcing members locally to provide the desired behavioral characteristics.

FIGS. 6 and 7 illustrate the average thickness e4 of the impact face in the vicinity of the toe portion 13. This average thickness e4 is lower than the average thickness e4 of the impact face in the vicinity of the heel portion so as to promote the positioning of the center of gravity toward the heel of the head.

Figure 8:
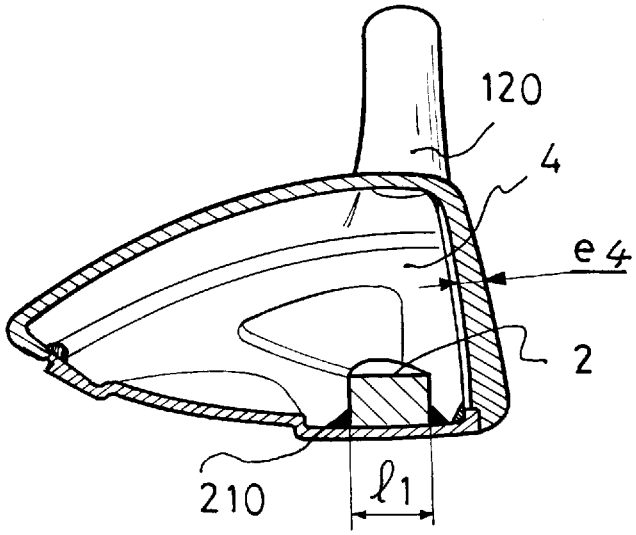
FIG. 8 is a cross-sectional view similar to FIG. 5, according to an alternative embodiment of the invention.
Figure 9:
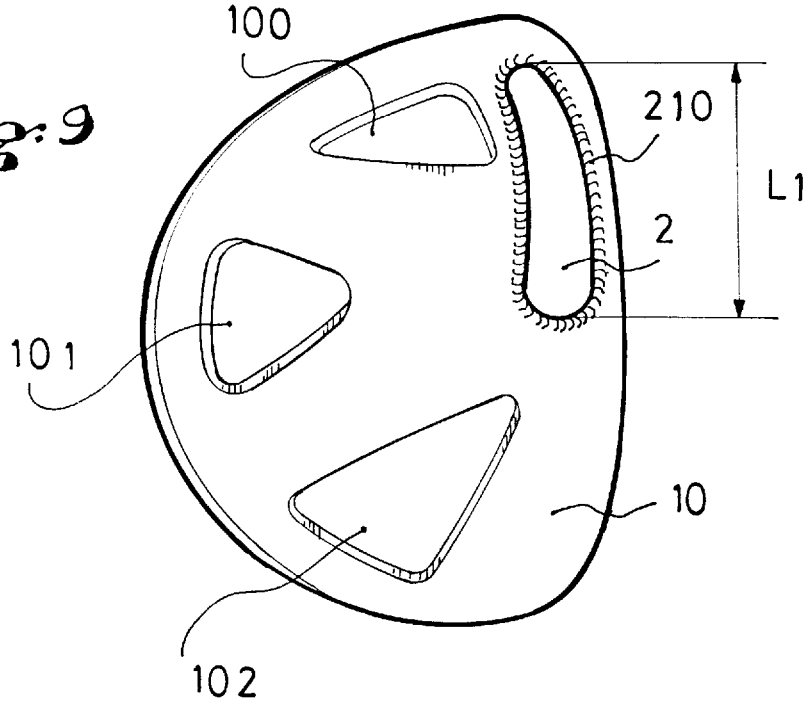
FIG. 9 is a view of the interface of the sole pattern of the head of FIG. 8.

FIGS. 8 and 9 illustrate an alternative embodiment of the invention in which the weight pad and the sole portion form two separate metallic members, connected together by connection means. The sole portion is desirably formed by hot pressing a metallic plate made of titanium or titanium based alloy. The hot pressing operation consists of conferring the specific concave shaped sole. During this operation, relief zones 100, 101 and 102 can be formed simultaneously. The weight pad may also be pressed under heat to form a complimentary shape to mate perfectly with the zone reserved for on the sole. The weight pad may then be affixed by weld joint 210 to the sole portion. Alternatively, the weight pad could be affixed by other techniques, such as screwing, tight adjustment, adhesion, etc. The weight pad is preferably made of the same material as the body of the head so that any potential problems of incompatibility during assembly or premature corrosion can be prevented. On the other hand, the weight pad could also be made of material which is denser than the material forming the body, such as lead, tungsten based materials, cuppro-berylium, steel, etc.

Figure 11:
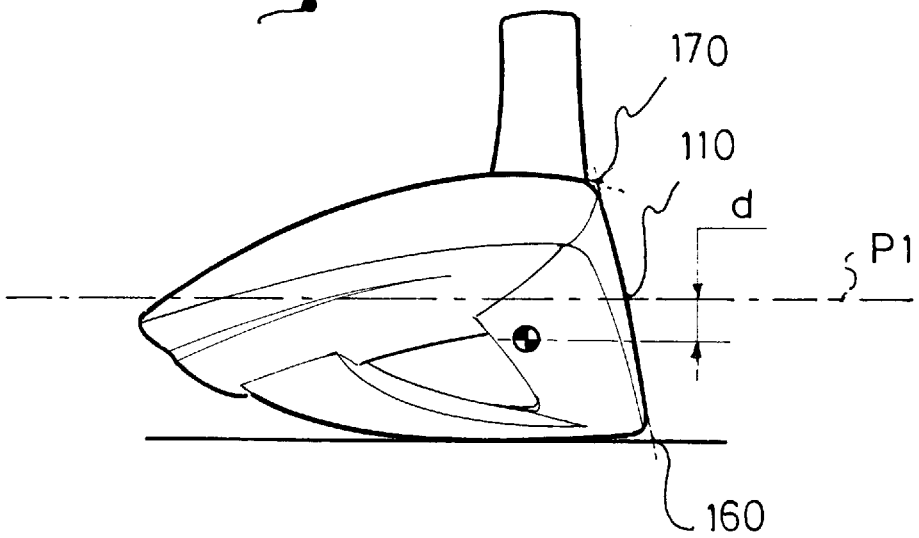
FIG. 11 is a simplified cross-sectional view showing the manner in which the center of the impact face of the club head is measured.

FIG. 11 illustrates the manner in which the center of the face is determined when the leading edge chamfered or rounded. The point 160 is considered to be the point of intersection between the extension line of the face and the extension line of the sole. The point 170 is likewise considered to be the point of intersection between the extension line of the face and the extension line of the crown. The center of the face is considered to be the median point on the line section between the point 160 and the point 170.

Table 1, below, provides the results of measuring nine metalwood type heads available on the market (examples 1–9) and three metalwood type heads according to the present invention (examples 10–12).

TABLE 1

| Prior art heads: | Volume (cc) | Weight (grams) | a (mm) | Δ1 (mm) | Δ2 (mm) | Iγ (Kg · mm2) | Loft (°) |
|---|---|---|---|---|---|---|---|
| Example 1 | 235 | 197.8 | −1.16 | 16.93 | 32.01 | 279.5 | 9.0 |
| Example 2 | 235 | 196.4 | −1.562 | 14.45 | 29.64 | 253.4 | 9.2 |
| Example 3 | 225 | 199.9 | −1.61 | 22.98 | 29.89 | 335.3 | 13.0 |
| Example 4 | 235 | 198.5 | 2.717 | 11.61 | 31.12 | 293.8 | 13.5 |
| Example 5 | 265 | 195.9 | 10.416 | 15.82 | 30.32 | 329.2 | 7.5 |
| Example 6 | 265 | 196.4 | 1.0545 | 14.45 | 27.46 | 320.5 | 9.0 |
| Example 7 | 235 | 201.4 | −1.812 | 21.73 | 30.71 | 328.8 | 14.0 |
| Example 8 | 250 | 193.2 | −2.69 | 15.64 | 32.56 | 264.5 | 11.5 |
| Example 9 | 235 | 209 | −0.31 | 13.44 | 33.82 | 321.2 | 10.0 |
| Invention: | | | | | | | |
| Example 10 | 265 | 197 | −1.16 | 13.9 | 31.3 | 313 | 8.5 |
| Example 11 | 285 | 197 | −1.5 | 15.2 | 32.1 | 323 | 9.5 |
| Example 12 | 285 | 197 | −1.5 | 15.2 | 32.1 | 323 | 10.5 |

All the prior art heads which have the center of gravity positioned in accordance with the dictates of the present invention, such as in examples 1 and 8 have a volume which is less than or equal to 250 cc and therefore cannot be considered to be oversized heads. The oversized heads of the prior art, which are designated as examples 5 and 6 have a volume of 265 cc and a high value of inertia, but have a center of gravity which is in a very high position above the center of the impact face. As discussed above, oversized heads typically have an undesirably high center of gravity. On the other hand, examples 10–12 give the parameters of the center of gravity and inertia which can be considered as being properly matched for three different lofted angled heads at 8.5 degrees, 9.5 degrees and 10.5 degrees.

This invention may be embodied in other forms, without departing from the spirit or essential characteristics thereof. The discussion of the preferred embodiment is therefore considered illustrative and not restrictive of the scope of the invention, with the scope of the invention being indicated by the appended claims, and all changes which come within the meaning and range of equivalency are therefore intended to be embraced therein.

What is claimed is:

1. An oversized metalwood type golf club head comprising:

a hollow body having an inner cavity delimited by a sole portion, an impact face with a center, a heel portion having an opening defining a shaft axis for the introduction of a shaft, a toe portion, a face portion and a crown portion linking said impact face, said toe portion, said heel portion and said rear face portion;

a weight pad being located along the sole portion said head having a center of gravity located generally closer to said heel portion than said toe portion, 0.5 to 4 mm beneath a horizontal plane passing through the center of the impact face, 27 to 33 mm from said shaft axis and 11 to 17 mm from a plane including said shaft axis and parallel to a horizontal line tangent to the impact face; and wherein said head has a total volume greater than or equal to 250 cc and a moment of inertia with respect to a vertical axis extending through the center of gravity which is greater than or equal to 300 $Kg.mm^2$.

2. The golf club head of claim 1, wherein said impact face has a thickness which generally increases in a vertical direction from the junction line between the impact face and the crown to the junction line between the impact face and the sole portion.

3. The golf club head of claim 2, wherein the thickness of the impact face proximate the heel portion is greater than the thickness of the impact face proximate the toe portion.

4. The golf club head of claim 3, wherein the thickness of the impact face varies between a minimal value less than or equal to 0.125 inches proximate the toe portion and a maximal value greater than or equal to 0.135 inches proximate the heel portion.

5. The golf club head of claim 1, wherein the thickness of the sole portion outside of the overlapping area of the weight pad is less than or equal to 0.055 inches and greater than or equal to 0.045 inches.

6. The golf club head of claim 1, wherein the thickness of the crown portion is less than or equal to 0.055 inches and greater than or equal to 0.045 inches.

7. The golf club head of claim 1, wherein said weight pad has a mass between 5 and 15 grams.

8. The golf club head of claim 1, wherein said head has a moment of inertia with respect to the vertical axis extending through the center of gravity which is greater than or equal to 320 $Kg.mm^2$.

9. The golf club head of claim 1, wherein said weight pad is made of the same material as said body and said weight pad has one of an average thickness between 0.07 and 0.4 inches which is greater than the average thickness of the rest of the sole portion.

10. The golf club head of claim 7, wherein said hollow body is made of titanium or titanium-base alloy.

11. The golf club head of claim 8, wherein said sole portion and said weight pad form a monobloc metallic assembly obtained by a casting operation.

12. The golf club head of claim 1, wherein said weight pad is made of a higher density material than the body.

13. The golf club head of claim 1, wherein said hollow body is made of a metal composite material having a density less than or equal to 2.6 g/cm$^3$.

14. The golf club head of claim 1, wherein said center of gravity is located 13 to 17 mm from a plane including the shaft axis and parallel to a horizontal line tangent to the impact face.

15. The golf club head of claim 1, wherein said weight pad has a mass between 10 and 50 grams.

* * * * *